US008324495B2

(12) United States Patent
Jacob

(10) Patent No.: US 8,324,495 B2
(45) Date of Patent: Dec. 4, 2012

(54) VOLUME-ADJUSTMENT CIRCUIT FOR EQUILIBRATING PICKUP SETTINGS

(76) Inventor: Bruce Ledley Jacob, Laurel, MD (US)

( * ) Notice: Subject to any disclaimer, the term of this patent is extended or adjusted under 35 U.S.C. 154(b) by 966 days.

(21) Appl. No.: 12/371,224

(22) Filed: Feb. 13, 2009

(65) Prior Publication Data

US 2010/0208916 A1 Aug. 19, 2010

(51) Int. Cl.
*G10H 1/46* (2006.01)
*G10H 3/12* (2006.01)

(52) U.S. Cl. ..... 84/741

(58) Field of Classification Search ..... 84/741, 84/742

See application file for complete search history.

(56) References Cited

U.S. PATENT DOCUMENTS

| | | | | |
|---|---|---|---|---|
| 2,525,696 | A | 10/1950 | Lurie | |
| 2,784,631 | A | 3/1957 | Fender | |
| 3,544,696 | A | 12/1970 | Broussard | |
| 3,873,921 | A | 3/1975 | Petrinee | |
| 4,010,668 | A | 3/1977 | Plueddemann | |
| 4,175,462 | A | 11/1979 | Simon | |
| 4,363,934 | A | 12/1982 | Scholz | |
| 4,545,278 | A * | 10/1985 | Gagon et al. | 84/726 |
| 5,136,919 | A | 8/1992 | Wolstein | |
| 5,682,003 | A | 10/1997 | Jarowsky | |
| 5,723,804 | A | 3/1998 | Replogle | |
| 5,763,808 | A * | 6/1998 | Thomson | 84/728 |
| 5,780,760 | A * | 7/1998 | Riboloff | 84/726 |
| 6,121,537 | A | 9/2000 | Pawar et al. | |
| 6,316,713 | B1 | 11/2001 | Furst et al. | |
| 6,781,050 | B2 * | 8/2004 | Olvera et al. | 84/743 |
| 7,915,506 | B2 * | 3/2011 | Jacob | 84/327 |
| 2004/0107822 | A1 * | 6/2004 | Olvera et al. | 84/743 |
| 2009/0308233 | A1 * | 12/2009 | Jacob | 84/726 |

* cited by examiner

*Primary Examiner* — Jeffrey Donels
(74) *Attorney, Agent, or Firm* — Timothy P. Monaghan, Esq.

(57) ABSTRACT

The disclosed volume-adjustment circuit sets the volume of each pickup setting in a topology-setting switch independent of other pickup topology settings in the switch. The volume-adjustment circuit has three parts: (1) a pickup topology selection switch that selects separate pickup-topologies, (2) separate and independent signal paths for chosen pickup-topologies, and (3) separate volume adjustment circuits in electrically separate and independent signal paths. Thus, the disclosure provides separate volume adjustment for selected pickup topologies of the pickup topology selection switch.

14 Claims, 19 Drawing Sheets

Single-pole switches

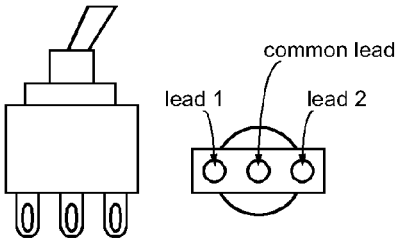

Single-pole, dual-throw switch (SPDT) side view (left) and bottom view (right)

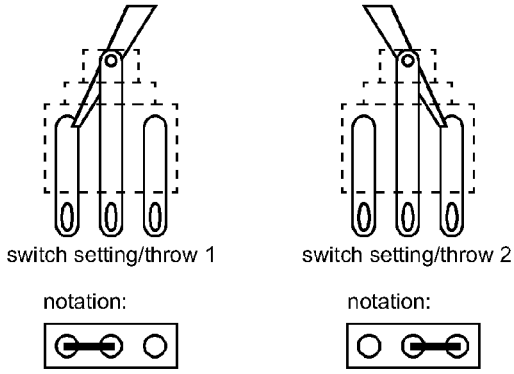

Internal implementation of the switch: the common lead in the center connects to the switch arm, which makes contact with a different output lead for each setting or "throw" of the switch. Notation is given below the illustration.

Ganged (multi-pole) switches

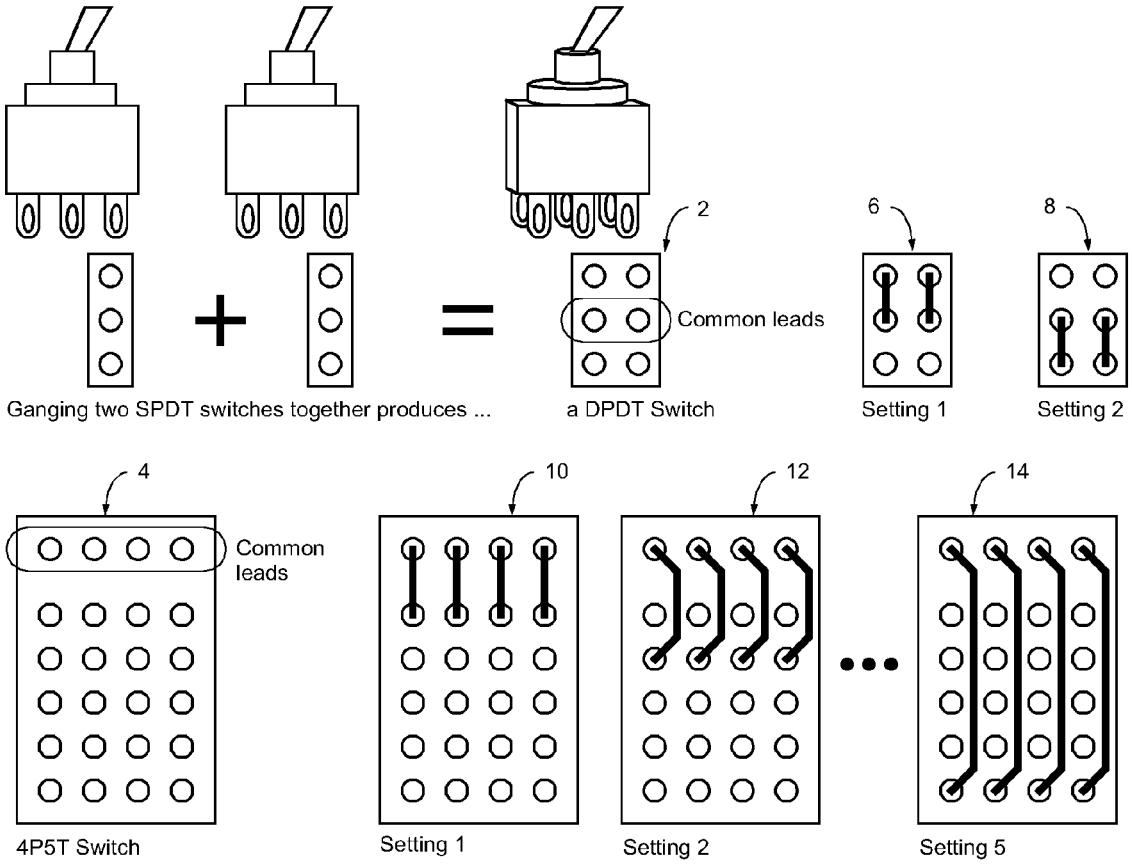

Figure 1
(prior art: ganged switch operation/notation)

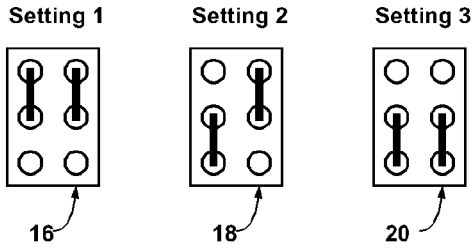
(a) The three settings of the DPDT on-on-on switch
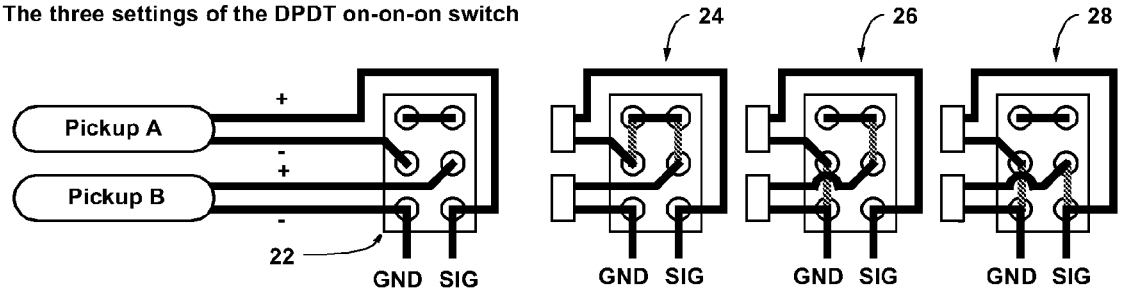
(b) The DPDT on-on-on switch wired 22 to produce Pickups A and B in series (#24, switch setting 1), Pickup A singly (#26, switch setting 2), and Pickup A in parallel with Pickup B (#28, switch setting 3)
Figure 2
(prior art: on-on-on DPDT switch operation)

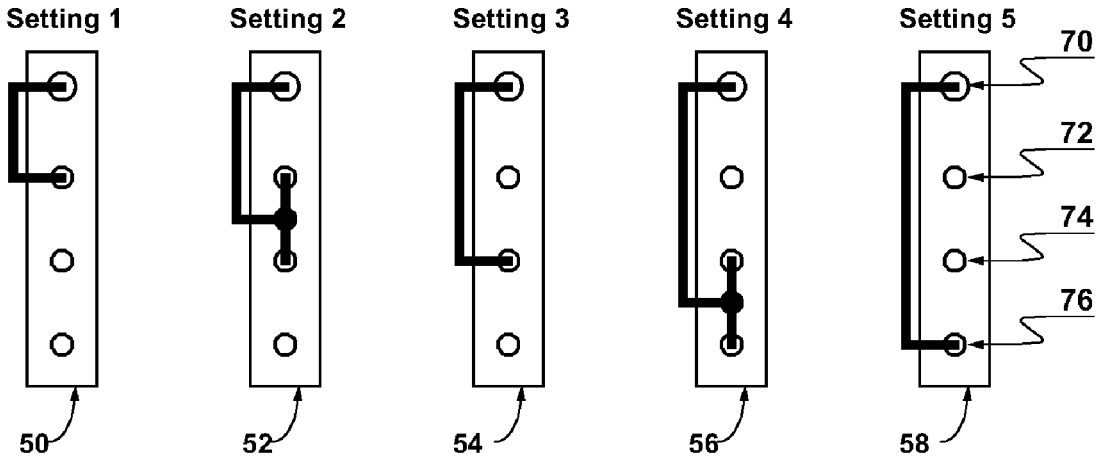
(a) The five settings of the basic Fender-style 5-way switch
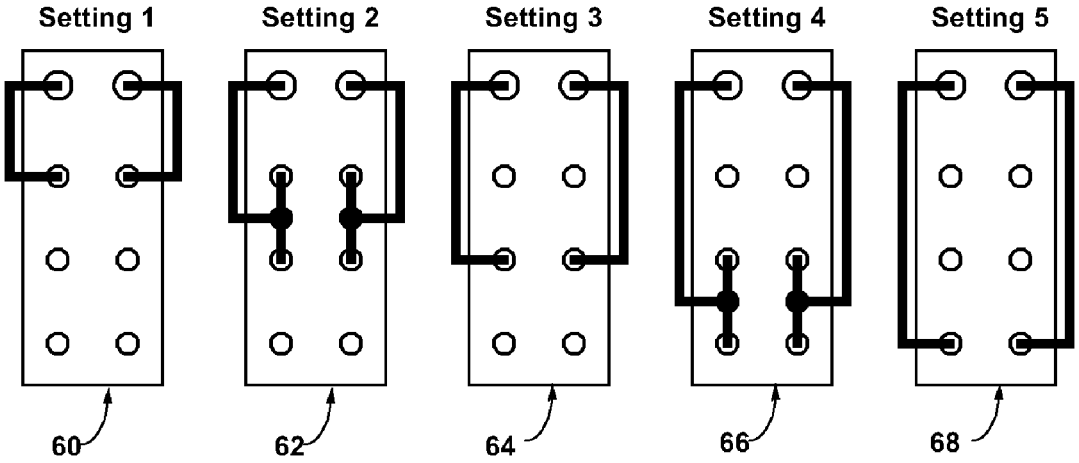
(b) Fender-style 5-way switch in dual-pole ganged configuration
Figure 3
(prior art: Fender-style 5-way switch operation)

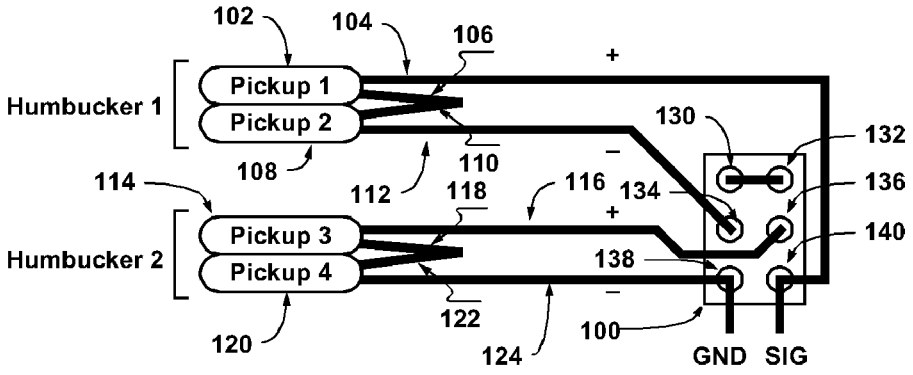
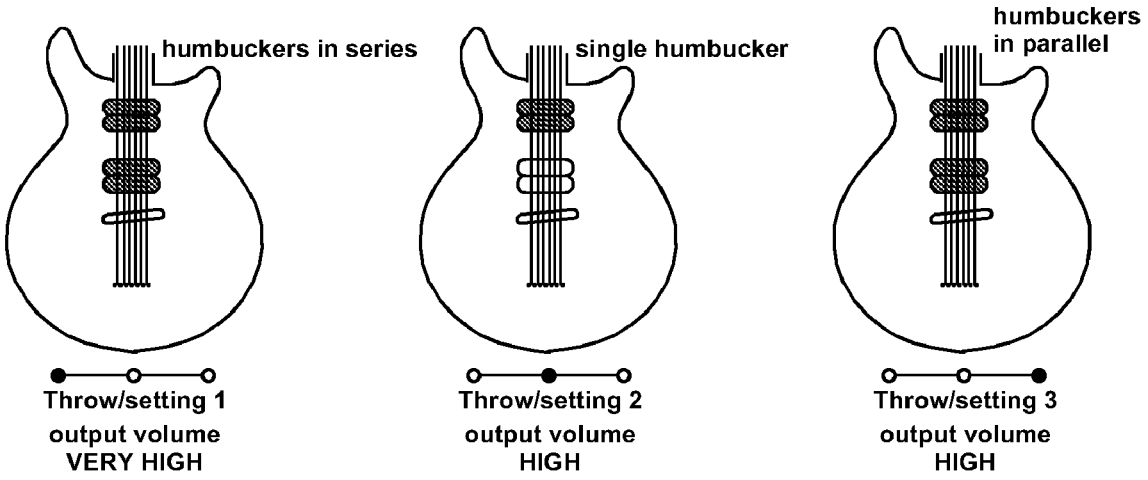
Figure 4
(prior art: common wiring modification of two-humbucker guitars)

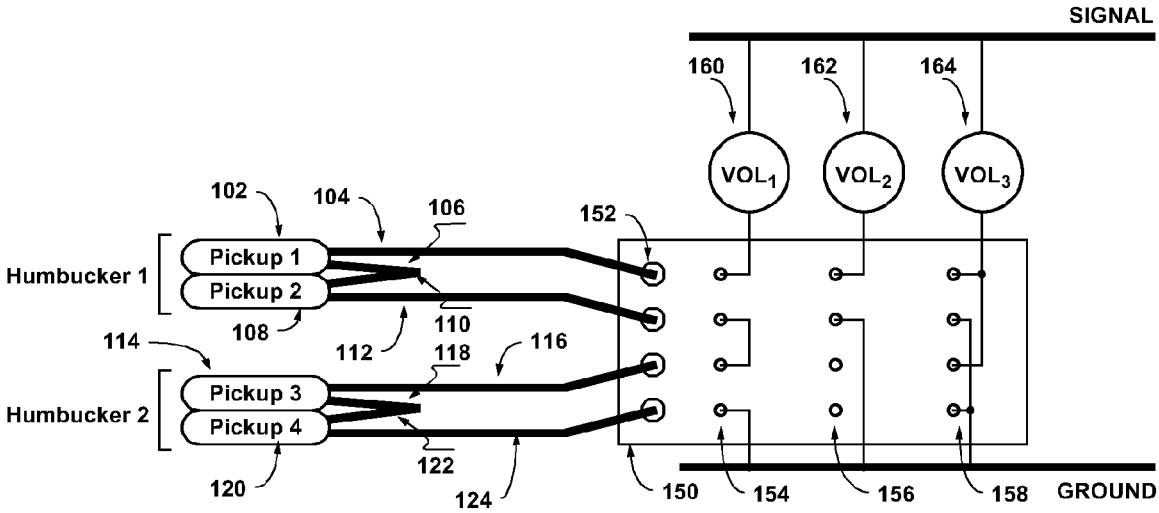
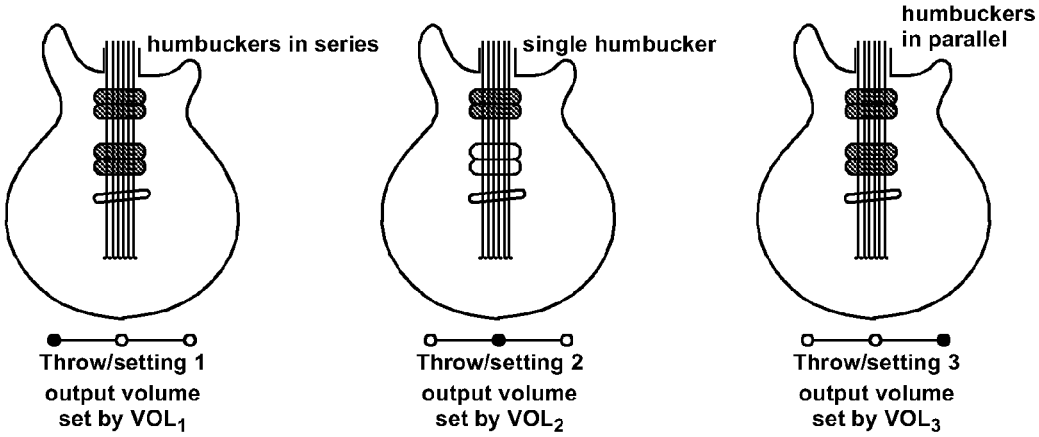
Figure 5

```
//
// Pseudo-VerilogAMS example (illustrative pseudocode)
//

// MACROS

// no voltage difference between a & b (short circuit)
‘define connect(a,b) V(a,b) <+ 0

// no current flows between a & b (open circuit)
‘define disconnect(a,b) I(a,b) <+ 0
```

Figure 6(a) (program listing)

```
//
// Pseudo-VerilogAMS example (illustrative pseudocode)
//

// on-on-on DPDT switch
// state of sw3_state determines common lead
// connected to which input lead
//
module onononDPDT_switch ( sw3_state, common, leads1, leads2);
    integer sw3_state;
    inout [1:0] common, leads1, leads2;

    analog begin if (sw3_state == 1'b1) begin
        connect (common[0], leads1[0]);
        connect (common[1], leads1[1]);
        disconnect (common[0], leads2[0]);
        disconnect (common[1], leads2[1]);
    end else if (sw3_state == 1'b2) begin
        disconnect (common[0], leads1[0]);
        connect (common[1], leads1[1]);
        connect (common[0], leads2[0]);
        disconnect (common[1], leads2[1]);
    end else begin
        disconnect (common[0], leads1[0]);
        disconnect (common[1], leads1[1]);
        connect (common[0], leads2[0]);
        connect (common[1], leads2[1]);
    end end
endmodule
```

Figure 6(b) (program listing)

```
//
// Pseudo-VerilogAMS example (illustrative pseudocode)
//

// a pickup-configuration switch implementing the following settings,
// given two humbuckers as inputs, tying them to outputs (signal & ground)
// in the following circuit topologies:
//   switch position 1: both humbuckers wired in series
//   switch position 2: humbucker 1 wired singly
//   switch position 3: both humbuckers wired in parallel
//
module pickup_switch ( sw3_state, hb1, hb2, signal, ground );
    integer sw3_state;
    input [1:0] hb1;
    input [1:0] hb2;
    inout signal, ground;

    electrical [3:0] common, leads1, leads2;

    onononDPDT_switch switch ( sw3_state, common, leads1, leads2);

    analog begin

        connect(leads1[0], leads1[1]);

        connect(common[0], hb1[1]);
        connect(common[1], hb2[0]);

        connect(leads2[0], hb2[1]);
        connect(leads2[1], hb1[0]);

        connect(ground, leads2[0]);
        connect(signal, leads2[1]);

    end
endmodule
```

Figure 6(c) (program listing)

```
//
// Pseudo-VerilogAMS example (illustrative pseudocode)
//

// MACROS

// no voltage difference between a & b (short circuit)
‘define connect(a,b) V(a,b) <+ 0

// no current flows between a & b (open circuit)
‘define disconnect(a,b) I(a,b) <+ 0
```

Figure 7(a) (program listing)

```
//
// Pseudo-VerilogAMS example (illustrative pseudocode)
//

// 1-pole three-way switch
// state of sw3_state determines common lead
// connected to which input lead
//
module 1p3t_switch ( sw3_state, common, lead1, lead2, lead3 );
    integer sw3_state;
    inout common, lead1, lead2, lead3;

    analog begin if (sw3_state == 1'b1) begin
        connect (common, lead1);
        disconnect (common, lead2);
        disconnect (common, lead3);
    end else if (sw3_state == 1'b2) begin
        disconnect (common, lead1);
        connect (common, lead2);
        disconnect (common, lead3);
    end else begin
        disconnect (common, lead1);
        disconnect (common, lead2);
        connect (common, lead3);
    end end
endmodule
```

Figure 7(b) (program listing)

```
//
// Pseudo-VerilogAMS example (illustrative pseudocode)
//

// 4-pole three-way switch
// (four 1p3t_switch modules ganged together by a common switch state)
//
module 4p3t_switch ( sw3_state, common, leads1, leads2, leads3 );
    integer sw3_state;
    inout [3:0] common, leads1, leads2, leads3;

    1p3t_switch sw0 ( sw3_state, common[0], leads1[0], leads2[0], leads3[0] );
    1p3t_switch sw1 ( sw3_state, common[1], leads1[1], leads2[1], leads3[1] );
    1p3t_switch sw2 ( sw3_state, common[2], leads1[2], leads2[2], leads3[2] );
    1p3t_switch sw3 ( sw3_state, common[3], leads1[3], leads2[3], leads3[3] );
endmodule
```

Figure 7(c) (program listing)

```
//
// Pseudo-VerilogAMS example (illustrative pseudocode)
//

// a 4P3T pickup-configuration switch implementing the following settings,
// given two humbuckers as inputs, tying them to outputs (signal & ground)
// in the following circuit topologies:
//   switch position 1: both humbuckers wired in series
//   switch position 2: humbucker 1 wired singly
//   switch position 3: both humbuckers wired in parallel
//
module pickup_switch_w_volume ( sw3_state, hb1, hb2, signal, ground );
    integer sw3_state;
    input [1:0] hb1;
    input [1:0] hb2;
    inout signal, ground;

    electrical [3:0] leads1, leads2, leads3;
    electrical throw1_out, throw2_out, throw3_out;

    volume_adjust vol1 ( throw1_out, signal, ground);
    volume_adjust vol2 ( throw2_out, signal, ground);
    volume_adjust vol3 ( throw3_out, signal, ground);

    4p3t_switch switch ( sw3_state, common, leads1, leads2, leads3 );

    analog begin

        connect(common[0], hb1[0]);
        connect(common[1], hb1[1]);
        connect(common[2], hb2[0]);
        connect(common[3], hb2[1]);

        connect(leads1[0], throw1_out);
        connect(leads1[1], leads1[2]);
        connect(leads1[3], ground);

        connect(leads2[0], throw2_out);
        connect(leads2[1], ground);

        connect(leads3[0], throw3_out);
        connect(leads3[1], ground);
        connect(leads3[2], throw3_out);
        connect(leads3[3], ground);

    end
endmodule
```

Figure 7(d) (program listing)

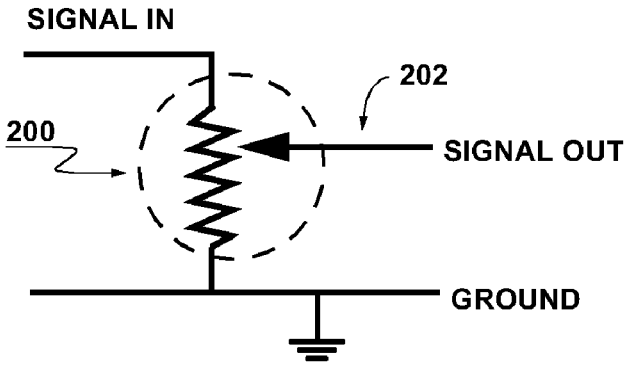
(a) an example of PASSIVE volume adjustment
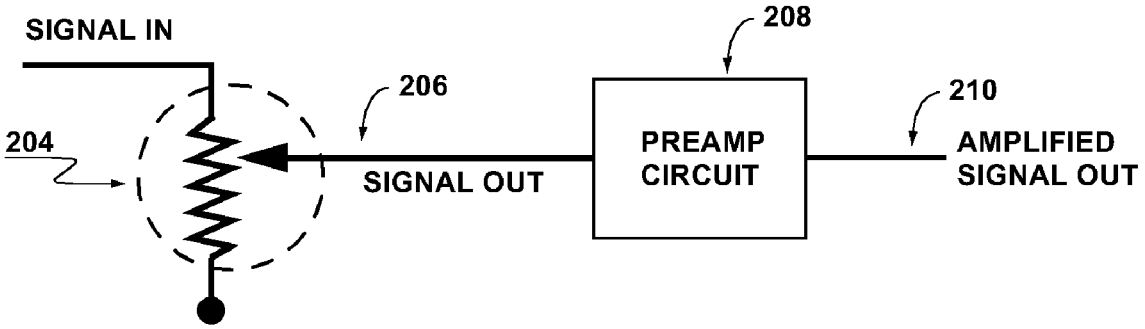
(b) an example of ACTIVE volume adjustment
Figure 8
(prior art volume adjustment sub-circuits)

(prior art: humbucker/single-coil/humbucker pickup configuration with 5-way)

VOLUME-ADJUSTMENT CIRCUIT FOR EQUILIBRATING PICKUP SETTINGS

BACKGROUND OF THE INVENTION

This invention relates to musical instruments having electronic pickups, for example electromagnetic, piezoelectric, or microphonic. Specifically, the embodiments disclose a volume-adjustment circuit that enables separate and independent volume control in a pickup topology switch.

A musical instrument that has an electronic pickup system produces significantly different sounds depending on the pickup topology of the musical instrument. For example, in an electric guitar, a pickup topology is the wiring of the pickups in series, in parallel, in phase or out of phase, as well as wiring together different combinations of pickups, depending on the number of pickups in the guitar.

Pickup topology switches are well-known in the prior art. It is common for pickup topology switches in the prior art to use ganged, multi-pole switches to select among multiple pickup topologies on the same guitar.

Ganged switches behave like multiple independent switches tied together. Two switches are illustrated in FIG. 1: a DPDT (dual-pole, dual-throw) switch 2 and a 4P5T (four-pole, five-throw) switch 4. In DPDT 2 the view of the switch is shown in 3 dimensions, and then from beneath: the switch itself is the solid rectangle, 3-dimensional view, with six leads exiting the bottom. FIG. 1 shows that dual-throw switches are normally illustrated with common leads in the center position, and switches with a larger number of settings are illustrated with common leads at the end. The two settings of the DPDT switch are shown in 6 and 8, with electrical connections between leads indicated by thick lines. The first two settings of the 4P5T switch are shown consecutively, 10 and 12, and the fifth setting is also shown, 14. The number of throws is equal to the number of switch settings; the number of poles represents the number of independent switches that are ganged together. Ganged, multi-pole switches are used in some embodiments of the disclosed invention. The notation of switches 2 and 4 is used herein.

A prior art example of the ganged switches used to switch between different circuit topologies is illustrated in FIG. 2(*a*). The "on-on-on" variant of the DPDT switch, which has not two but three settings, illustrated in 16, 18, and 20, can provide combinations of series 24, parallel 28, and single-pickup 26 selections, given two pickups as input. Another prior art example, similar to the on-on-on variant of the DPDT switch is the Fender-style variant of a 5-way (1P5T) switch, illustrated in FIG. 3. The single-pole configuration is shown in FIG. 3(*a*); though the switch has five settings 50, 52, 54, 56, and 58 (five throws), it has one common lead 70 and three (not five) setting leads 72 74 76. Settings 1 50, 3 54, and 5 58 of the switch connect setting leads 1 72, 2 74, and 3 76 to the common pole 70, respectively. Setting 2 52 of the switch connects setting leads 1 72 and 2 74 to each other and to the common lead 70; setting 4 56 of the switch connects setting leads 2 74 and 3 76 to each other and to the common lead 70. The five settings 60 62 64 66 68 of the dual-pole configuration of the switch are illustrated in FIG. 3(*b*).

In prior art guitar pickup topologies, Gibson electric guitars are known, to one of ordinary skill in the art, for the "thick" sound of the electric guitar. Gibson produces this sound by wiring pickups in series. In another well-known guitar, the Fender Stratocaster, its sound is bright with bell-like harmonics, which are produced by wiring pickups in parallel, or the guitarist can switch to a single pickup, via a switch on the surface of the guitar. The Fender Stratocaster then produces a clear and "clean" sound. Custom wirings, typically produced in the lab or studio, have experimented with out-of-phase topologies as well.

Most guitarists have a number of different pickup topologies that they prefer. However, different pickup topologies can produce significant changes in volume. For example, wiring multiple pickups in series produces a much louder volume than when wiring one of those pickups alone. Wiring two pickups in parallel produces a volume similar to wiring one of those pickups alone. Wiring two pickups out of phase with respect to each other subtracts one signal from the other, thereby canceling out much of the signal and reducing volume significantly. Thus, pickup topology switches that mix different pickup topologies in the same guitar produce significant changes in output volume.

In the prior art, most guitar pickup switches limit the topology selections to those that produce similar volume levels. In particular, two of the most popular guitars, the Gibson Les Paul and the Fender Stratocaster, do not mix topologies that have different volume levels, and so in each guitar the pickup settings all have the same volume. Specifically, the Les Paul wires humbuckers (a pickup comprised of two pickups wired in series) singly or two humbuckers in parallel, both of which topologies have similar volume levels; the Stratocaster wires single pickups by themselves or two pickups in parallel, both of which topologies have similar volume levels. Both guitar designs ensure that all pickup topologies available on the guitar are volume-compatible with each other, by disallowing volume-incompatible pickup topologies. However, this volume compatibility comes at the cost of limiting the available pickup topologies and thus the sounds that each guitar can produce.

While the separation of multiple audio channels, each with its own volume setting, is used in other domains such as mixing boards and amplifiers, it has never been implemented in musical instruments having electronic pickups. There is a long felt need in the art for separate and independent volume adjustment for each pickup topology in a pickup switch used on the same musical instrument. The volume-topology problem exists in all prior art topology switches.

SUMMARY OF THE INVENTION

It is therefore an object of the present invention to provide a volume-adjustment circuit that sets the volume level of selected pickup topologies independently.

The disclosed invention provides a volume-adjustment circuit for equilibrating pickup settings. The volume-adjustment circuit has a pickup topology switch with m-switch settings, and at least two switch settings have different circuit topologies. At least two pickup topologies selected by the switch have separate and independent signal paths. A volume adjustment circuit is inserted in chosen signal paths, providing a separate volume adjustment for each chosen pickup topology.

It is still a further object of the invention to provide both hardware and software embodiments of the switch, and embodiments that are a mix of hardware and software components.

It is still further an object of the invention to provide both active and passive volume-adjustment circuits.

BRIEF DESCRIPTION OF THE DRAWINGS

FIG. 1 is a detailed description of prior art single pole and ganged multi-pole operation and the notation used herein to describe those switches.

FIG. 2 is an example of a prior art usage of an on-on-on DPDT switch operation.

FIG. 3 is an illustration of a prior-art 5-way switch variant, in 1P5T and 2P5T configurations.

FIG. 4 is an example of a prior-art pickup-selection switch and the pickup combinations that it produces.

FIG. 5 is an embodiment that could be applied to the pickup-switch example in FIG. 4.

FIGS. 6(*a*), 6(*b*), and 6(*c*) combined present a code listing: a Hardware Description Language (HDL) implementation of the example in FIG. 4.

FIGS. 7(*a*), 7(*b*), 7(*c*), and 7(*d*) combined present a code listing: a Hardware Description Language (HDL) implementation of the embodiment in FIG. 5.

FIG. 8 illustrates prior-art circuits for passive and active volume adjustment in single audio channels.

DETAILED DESCRIPTION OF EMBODIMENTS

Figure 9:
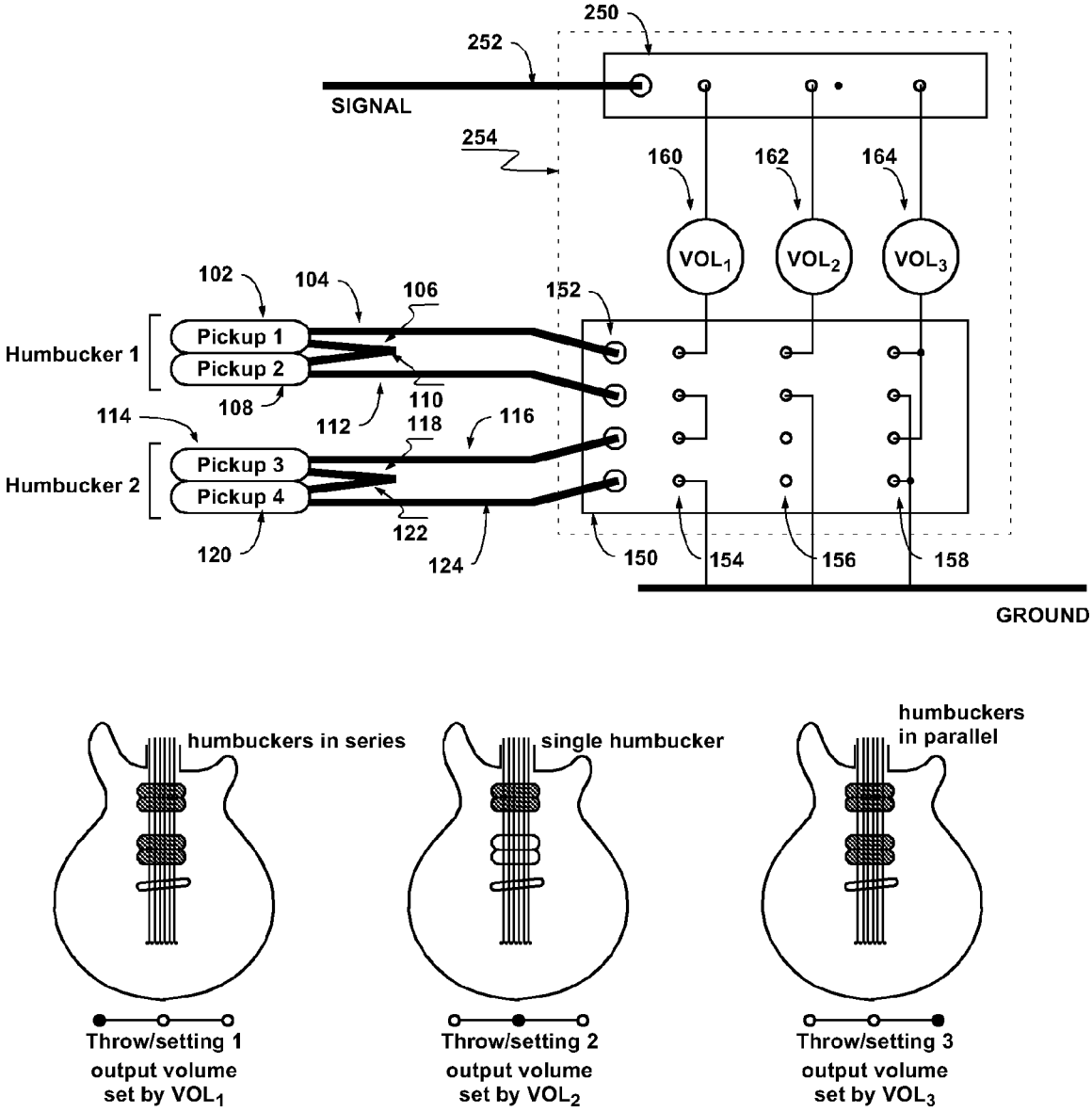
FIG. 9 illustrates the embodiment in FIG. 5 modified to support passive volume adjustment.

The present invention is a volume-adjustment circuit for equilibrating pickup settings. The invention disclosed herein is susceptible of a range of embodiments many different forms of hardware, software, or a mix of hardware and software components. In the current state of electronics technology, the line between hardware and software continues to blur. The disclosure includes both hardware and software embodiments. Shown in the drawings and described herein are preferred embodiments of the invention. As would be recognized by those skilled in the art, the present disclosure is an exemplification of the principles of the claimed invention and does not limit the invention to the illustrated embodiments.

Embodiments of the invention have a switch that has separate and independent signal path for each pickup topology of the switch. FIG. 4 shows a common wiring modification made to dual-humbucker guitars (guitars with four pickups wired as two humbuckers, each humbucker a pair of single-coil pickups wired in series) and a single three-way pickup-selection switch. FIG. 4 provides the following pickup topologies for the switch's three settings:

Switch position 1 (throw 1) connects the negative lead of humbucker 1 to the positive lead of humbucker 2. The positive lead of humbucker 1 is hard-wired to the SIG output, and the negative lead of humbucker 2 is hard-wired to the GND output. Thus, this switch setting puts the two humbuckers in series, a pickup topology that has all four individual pickups in series and has a very high output volume.

Switch position 2 (throw 2) connects the negative lead of humbucker 1 to the GND output. The positive lead of humbucker 1 is hard-wired to the SIG output; thus, this switch setting wires humbucker 1 to the output, a pickup topology that has a high output volume, but not as high as two humbuckers in series.

Switch position 3 (throw 3) connects the positive lead of humbucker 2 to the SIG output and the negative lead of humbucker 1 to the GND output. The positive lead of humbucker 1 is hard-wired to the SIG output, and the negative lead of humbucker 2 is hard-wired to the GND output. Thus, this switch setting puts the two humbuckers in parallel, a pickup topology that involves all four individual coils. It has an output volume as high as a single humbucker, but not as high as two humbuckers in series.

Although the switch in FIG. 4 provides for three separate pickup-topology settings, it does not provide separate, independent signal paths.

FIG. 5 shows an embodiment of the topology switch design of the claimed invention. The switch has three separate, independent signal paths, one for each pickup-topology setting. In FIG. 5 a 4P3T switch is used to implement the series/single/parallel function of the on-on-on DPDT switch, and it should be clear that this embodiment does provide for a separate, independent signal path for each pickup-topology setting. In the figure, the switch 150 is chosen and the pickup-topology circuits are designed such that the local SIGNAL outputs of the different pickup-topology settings (settings 154, 156, and 158) are distinct and separated from each other. This enables the insertion of volume-control circuitry 160 162 164 into each local SIGNAL path; the $VOL_n$ sub-circuits (for n=1, 2, 3) indicate separate volume-control adjustment circuits for switch settings 1, 2, 3, respectively. Thus, a separate volume adjustment is implemented for each pickup topology setting. The buffering of the switch 150 prevents any interaction between these separate volume-adjustment circuits.

As noted, the disclosed volume-adjustment circuit can be implemented in software such as in a HDL (hardware description language) embodiment. FIG. 6 discloses the circuit of FIG. 4 in an HDL embodiment. FIG. 7 shows the embodiment of FIG. 5 in an HDL implementation. The HDL, Verilog, is disclosed using VerilogAMS. However, any hardware description language is just as suitable. HDLs allow the simulation, verification and test of a design before any hardware or software components are built. Verilog allows for the description of a design at a behavioral level, a register level (RTL), or a gate level description. Once the Verilog code is tested and verified it could be implemented in for example PLDs, ASICs, Field Programmable Gate Arrays (FPGAs), or software running on a processor core.

The components shown in FIG. 6 are the Verilog software modules that combined will compile into an implementation of the pickup-topology selection switch shown in FIG. 4. The connect( ) and disconnect( ) macros are Verilog-AMS notation to show that two wires throughout the FIG. 6 code are connected or not connected to each other.

The ononDPDT_switch module implements an on-on-on variant of the DPDT switch. The switch's "common" wires are connected to the "lead1" wires (and disconnected from the "lead2" wires) if the switch's state is 1. The "common" wires are connected to the "lead2" wires (and disconnected from the "lead1" wires) if the switch's state is 3. If the switch's state is 2, corresponding to the middle "on" position of the switch, the wiring connections are as shown in FIG. 2, diagram 18: the rightmost of the "lead1" leads is connected to its common output, and the leftmost of the "lead2" leads is connected to its common output; all other leads are disconnected from the common outputs. The switch's state could be a value read from memory cells or generated by combinational logic, or it could be a physical state such as a pair of jumpers being set, a switch lever or dial being placed in a certain position, or a set of fuses being set or blown.

The onononDPDT_switch is used in the pickup_switch module, which implements the wiring configuration shown in FIG. 4. The switch 100 has two top leads 130 132 ("leads1[0]" and "leads1[1]" in the code) that are connected to each other. The leftmost common lead 134 ("common[0]" in the code) is connected to the negative lead 112 of humbucker 1 ("hb1[1]" in the code). The rightmost common lead 136 ("common[1]" in the code) is connected to the positive lead 116 of humbucker 2 ("hb2[0]" in the code). The leftmost lead 138 of the two bottom leads 138 140 ("leads2[0]" in the code) is connected to the negative lead 124 of humbucker 2 ("hb2[1]" in the code); it is also connected to the GND, or ground, wire ("ground" in the code). The rightmost lead 140 of the two bottom leads 138 140 ("leads2[1]" in the code) is connected to the positive lead 104 of humbucker 1 ("hb1[0]" in the code); it is also connected to the SIG, or signal, wire ("signal" in the code).

The components shown in FIG. 7 are the Verilog software modules that combined will compile into an implementation of the pickup-topology selection switch shown in FIG. 5. The connect( ) and disconnect( ) macros are Verilog-AMS notation to show that two wires throughout the FIG. 7 code are connected or not connected to each other.

The 1p3t_switch module implements a single three-way switch. A 1P3T switch is similar in function to the single pole, multiple throw switches shown in FIG. 1. The "common" wire is connected to one and only one of the wires "lead1" "lead2" and "lead3" in a three state switch. If the switch's state is "1", the "common" wire is connected to the "lead1" wire; if the switch's state is "2", the "common" wire is connected to the "lead2" wire; if the switch's state is "3", the "common" wire is connected to the "lead3" wire. The three-way switch's state can come from a wide variety of sources, such as but not limited to a value read from memory cells or generated by combinational logic, or it could be a physical state such as a pair of jumpers being set, a switch lever or dial being placed in a certain position, or a set of fuses being set or blown.

The 4p3t_switch module gangs together four 1P3T switches. The three 1P3T switches are all driven off the same switch state, and are thus "ganged" in the sense depicted in FIG. 1.

The pickup_switch_w_volume module is an HDL implementation of the embodiment shown in FIG. 5, using the Verilog modules described above. It also uses a volume_adjust module which could take the form of, but is not limited to, one of the circuits in FIG. 8. The switch's leads are connected as shown in FIG. 5, using the "connect" macros as described above. The poles 152 of the switch 150 are connected to the pickups. The positive 104 and negative 112 leads of humbucker 1 ("hb1[0]" and "hb1[1]" in the code) are connected to the first two poles of the switch 150 ("common[0]" and "common[1]" in the code). The positive 116 and negative 124 leads of humbucker 2 ("hb2[0]" and "hb2[1]" in the code) are connected to the last two poles of the switch 150 ("common[2]" and "common[3]" in the code). The setting 1 leads 154 are wired to put the pickups in series when the switch 150 is placed in setting 1: "leads[0]" is connected to "setting1_out" which connects to the SIGNAL output through the VOL1 volume adjust sub-circuit 160 ("vol1" in the code); "leads1[1]" is connected to "leads1[2]" which puts the two pickups in series in this setting; and "leads1[3]" is connected to GROUND. The setting 2 leads 156 are wired to connect humbucker 1 to the output (SIGNAL and GROUND) when the switch 150 is placed in setting 2: "leads2[0]" is connected to "setting2_out" which connects to the SIGNAL output through the VOL2 volume adjust sub-circuit 162 ("vol2" in the code); "leads2[1]" is connected to GROUND; "leads2[2]" and "leads2[3]" are not connected to anything. The setting 3 leads 158 are wired to put the pickups in parallel when the switch 150 is placed in setting 3: "leads3[0]" and "leads3[2]" are both connected to "setting3_out" which connects to the SIGNAL output through the VOL3 volume adjust sub-circuit 164 ("vol3" in the code); "leads3[1]" and "leads3[3]" are both connected to GROUND.

As mentioned, the volume adjustment sub-circuits can take many forms; FIG. 8 shows just two examples of active and passive circuit design. For example, in a typical electric guitar, the volume adjustment is passive and is implemented as shown in FIG. 8(*a*): a simple potentiometer 200 is wired between SIGNAL and GROUND, with the wiper of the pot 202 providing the final OUTPUT. In guitars with active preamps, circuits such as FIG. 8(*b*) can be used: a simple potentiometer 204 is used to create a variable resistor in series with the SIGNAL input 206 of the preamp 208, which then provides the final OUTPUT 210. The $VOL_n$ sub-circuits in the FIG. 5 and FIG. 7 embodiments could easily be implemented in either fashion. One of ordinary skill in the art would recognize that other volume-adjustment circuits could be used in place of these examples. The design of the topology selection switch alleviates circuit interactions between switch settings, even if the circuits all share a common GROUND. The only additional buffering arises due to choice of volume-control circuitry, detailed below.

It is important to note that the circuit in FIG. 8(*b*) is directly applicable to the circuit of the FIG. 5 embodiment, whereas the circuit in FIG. 8(*a*) is not. Were one to implement the volume controls $VOL_1$ $VOL_2$ and $VOL_3$ using the circuit in FIG. 8(*a*), one would have three resistances in parallel between SIGNAL and GROUND, which is effectively one single resistance between SIGNAL and GROUND; i.e., the three volume adjust circuits would not be independent of each other.

Figure 12:
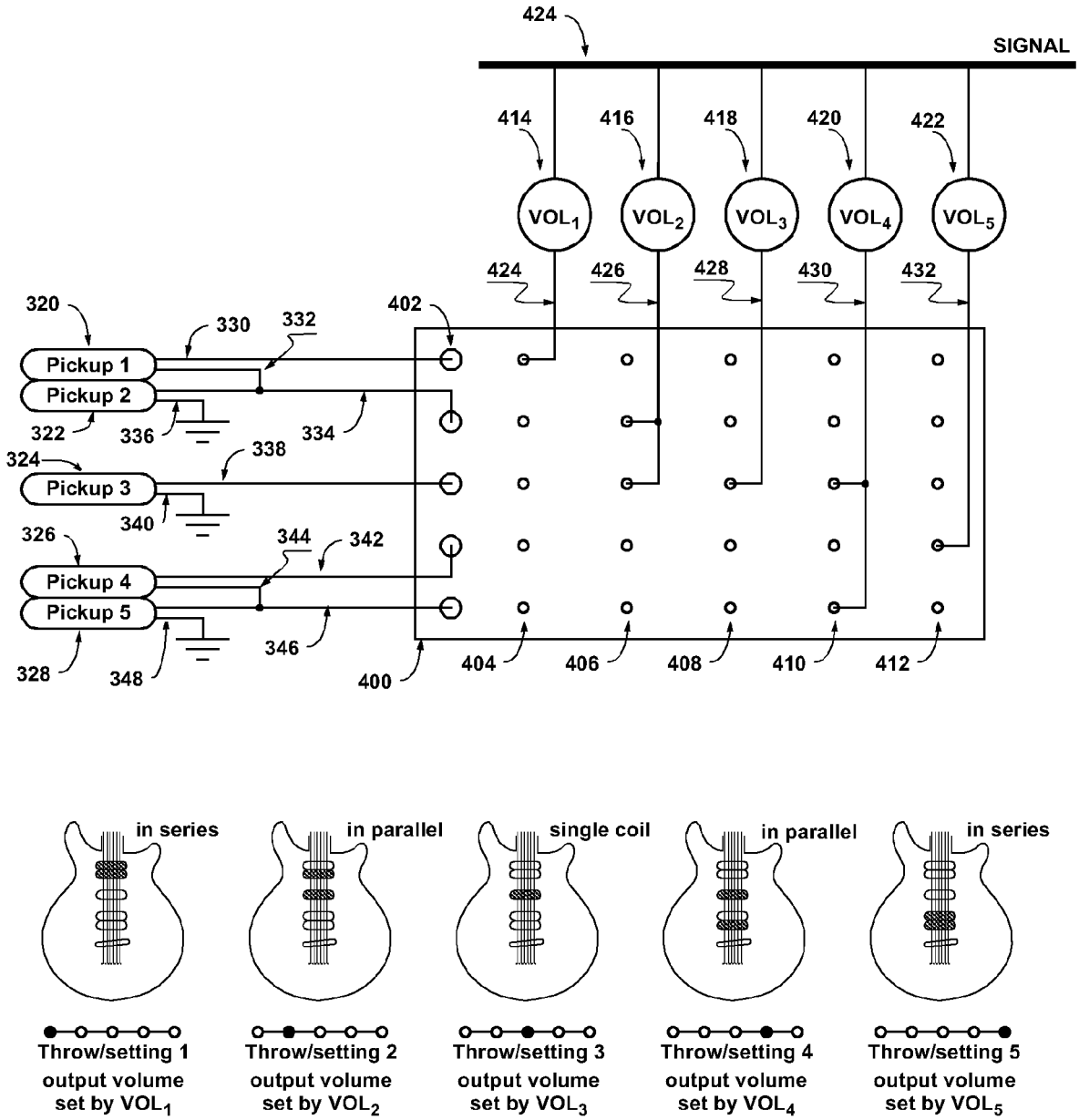
FIG. 12 is an embodiment that could be applied to the pickup-switch example in FIGS. 10 and 11.
Figure 13:
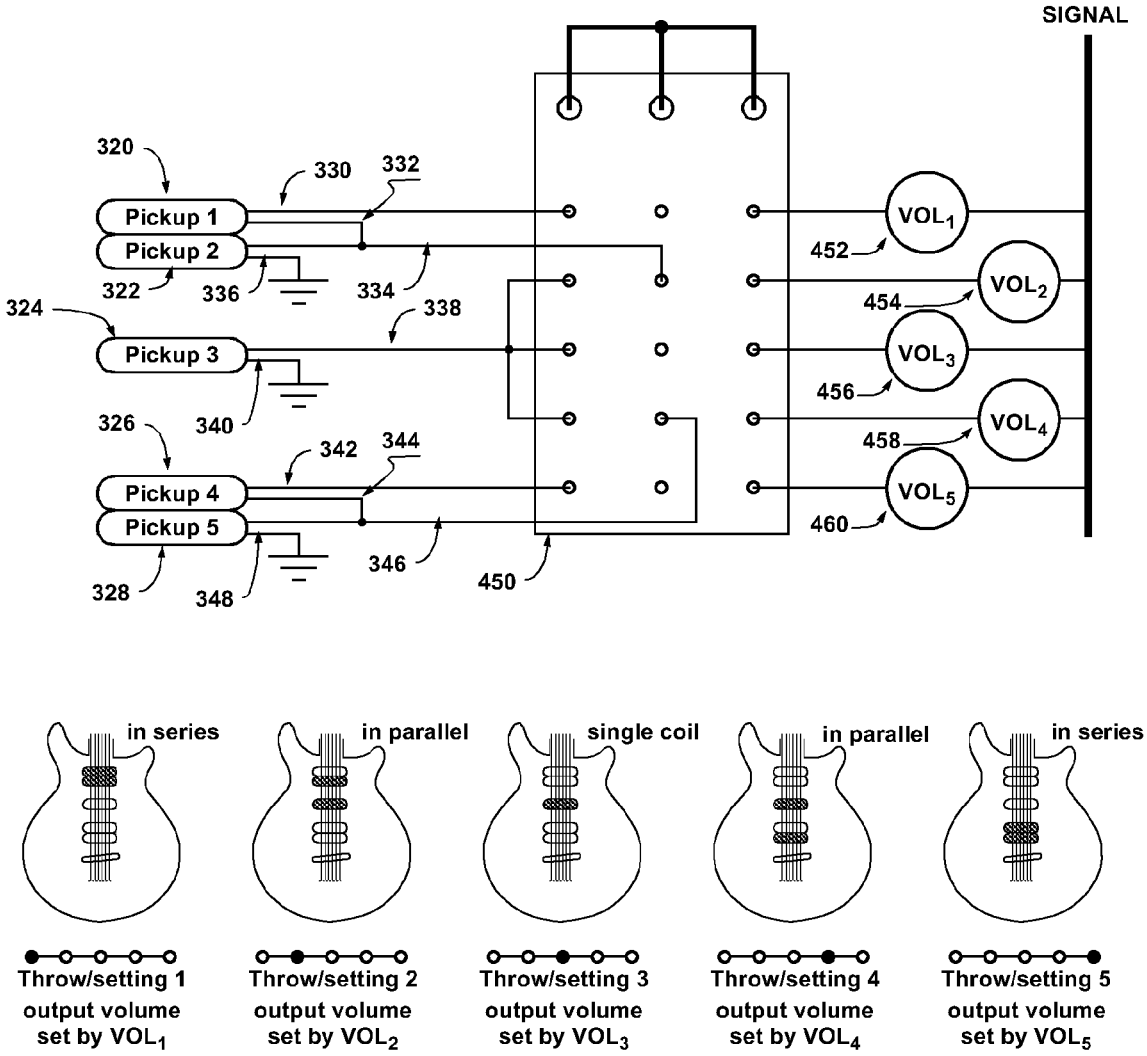
FIG. 13 is another embodiment that could be applied to the pickup-switch example in FIGS. 10 and 11.
Figure 14:
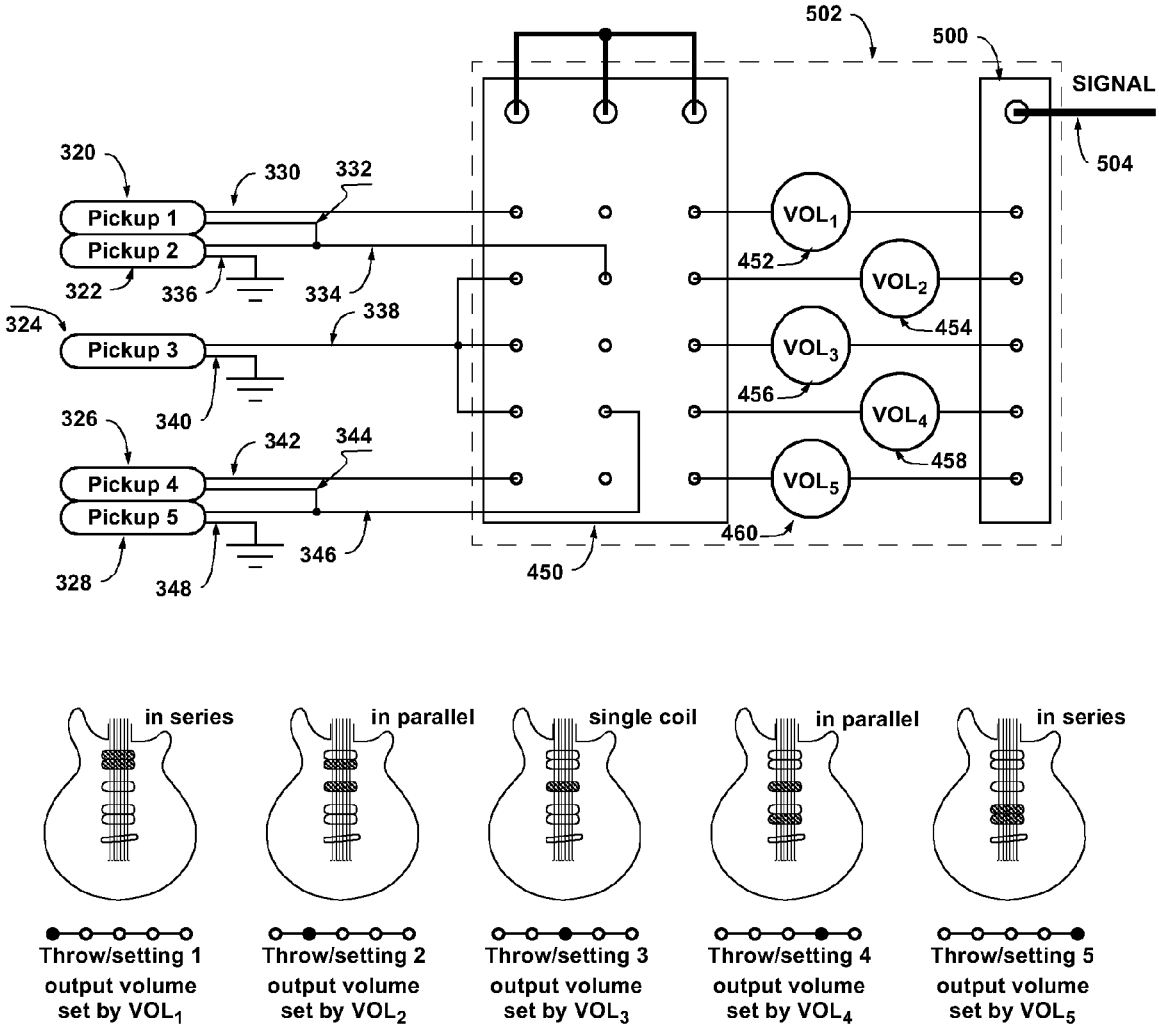
FIG. 14 illustrates the embodiment in FIG. 13 modified to support passive volume adjustment.

One solution to this, to enable the use of the passive volume control shown in FIG. 8(*a*), is to insert another switch into the signal path. FIG. 9 shows such an embodiment. Here, a 1P3T switch 250 is used to buffer the separate signal paths from each other such that only one of the various resistances between SIGNAL and GROUND is connected into the signal path at any given time. A person of ordinary skill in the art would recognize that this additional switch could simply be part of a larger ganged switch 254 that encompasses both the pickup-topology selection switch 150 and the switch used to buffer the signals 250. Note also that it is not always necessary to add another switch to perform this buffering; for instance, the embodiments in FIGS. 12, 13, and 14 show that one can simply re-design the circuit and use the same switch to accomplish the goal. Additionally, sometimes a switch pole is being used unnecessarily; for instance, the embodiments in FIGS. 5 and 9 use all four poles 152 of the 4P5T switch 150, but one can see that the negative lead 124 of humbucker 2 is always connected (through the switch) to GROUND, if the humbucker is being used. Therefore, given this set of pickup topologies, one could hard-wire that lead to GROUND directly, thereby freeing up an entire switch pole (i.e., a row of the 4P5T switch 150), which would enable the embodiment of FIG. 9, volume adjustment and all (i.e. including both pickup selection 150 and volume-adjust buffering 250 switches into a single switch 254), to be implemented in a single 4P5T switch.

Figure 10:
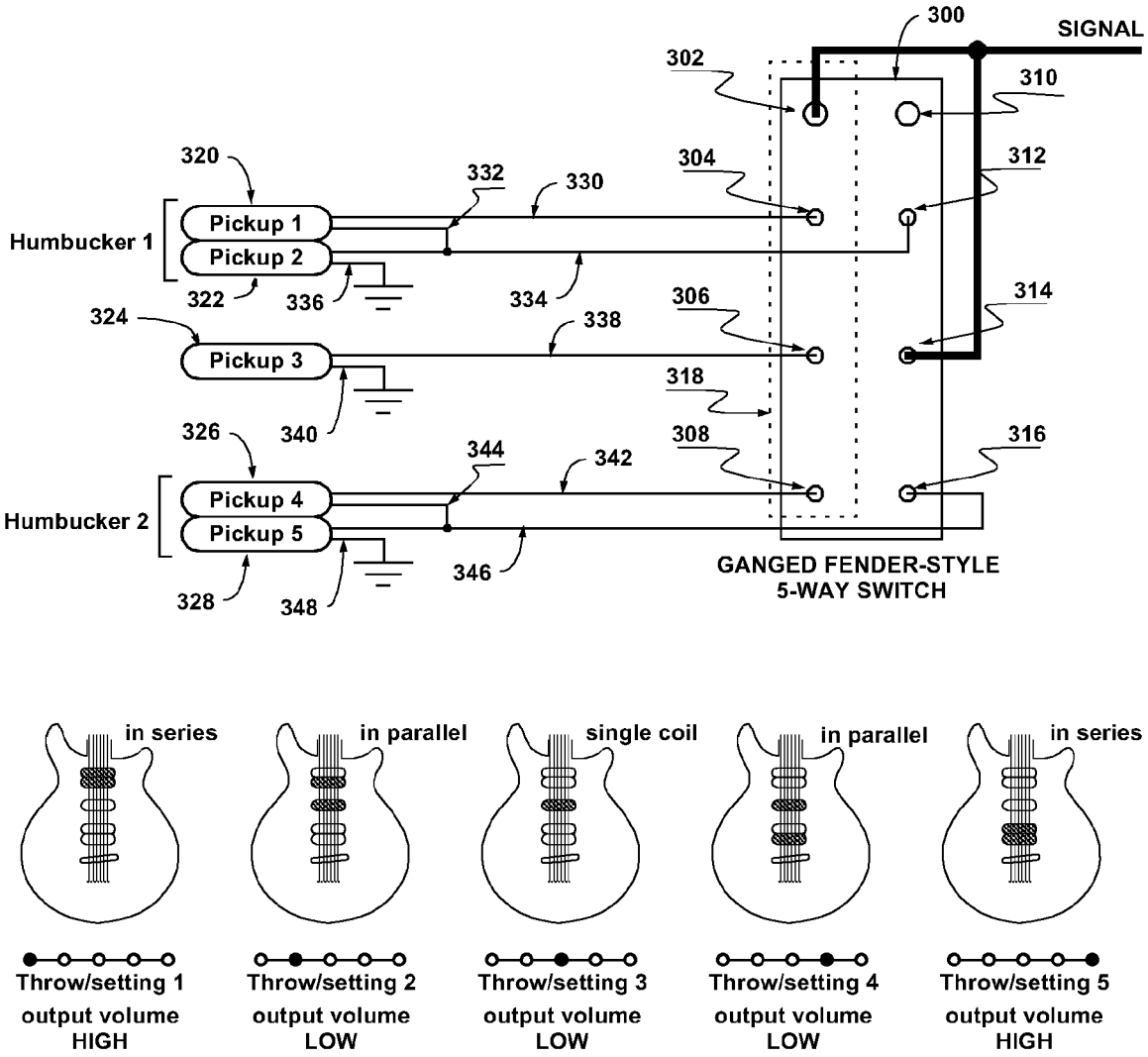
FIG. 10 is an example of a prior-art pickup-selection switch and the pickup combinations that it produces.

FIG. 10 illustrates a slightly more complex example of a pickup and switch configuration that can be found in stock commercial guitars. It has five pickups 320 322 324 326 328, arranged as two humbuckers and a single coil between them. A five-throw switch 300 (Fender-style 5-way) is used.

Pickup 1's positive lead 330 is connected to setting lead 304. Pickup 1's negative lead 332 is connected to pickup 2's positive lead 334, which is also connected to setting lead 312. Pickup 2's negative lead 336 is connected to GROUND. Pickup 3's positive lead 338 is connected to the switch's setting lead 306. Pickup 3's negative lead 340 is connected to GROUND. Pickup 4's positive lead 342 is connected to setting lead 308. Pickup 4's negative lead 344 is connected to pickup 5's positive lead 346, which is also connected to setting lead 316. Pickup 5's negative lead 348 is connected to GROUND. The switch's common lead 302 and setting lead 314 are connected to each other and the SIGNAL output.

The example provides the following circuit topologies for the illustrated switch's five settings. Note the behavior of the Fender-style 5-way switch is illustrated in FIG. 3.

In switch position 1, common lead 302 is connected to setting lead 304, and common lead 310 is connected to setting lead 312. Switch position 1 thus connects humbucker 1's positive lead 330 to SIGNAL. Humbucker 1's negative lead 336 is hard-wired to ground, so this switch position represents humbucker 1 (pickups 1 320 and 2 322 wired in series), which has a high output volume.

In switch position 2, common lead 302 is connected to both setting lead 304 and setting lead 306, and common lead 310 is connected to both setting lead 312 and setting lead 314. Switch position 2 thus connects humbucker 1's positive lead 330 and single-coil pickup 3's positive lead 338 both to SIGNAL. The switch also connects humbucker 1's "coil tap" 332 (the negative lead 332 for pickup 1, which is connected to the positive lead 334 for pickup 2) to SIGNAL, thereby cutting pickup 1 out of the circuit. Both pickup 2's negative lead 336 and pickup 3's negative lead 340 are hard-wired to ground, so this switch position represents pickup 2 322 and pickup 3 324 wired in parallel. This setting has a noticeably lower output volume than that of setting 1.

In switch position 3, common lead 302 is connected to setting lead 306, and common lead 310 is connected to setting lead 314. Switch position 3 thus connects pickup 3's positive lead 338 to SIGNAL. Pickup 3's negative lead 340 is hard-wired to ground, so this switch position represents the single-coil pickup 3 324 wired alone. This setting has a noticeably lower output volume than that of setting 1 and is approximately equal to the output volume of setting 2.

In switch position 4, common lead 302 is connected to both setting lead 306 and setting lead 308, and common lead 310 is connected to both setting lead 314 and setting lead 316. Switch position 4 thus connects humbucker 2's positive lead 342 and single-coil pickup 3's positive lead 338 both to SIGNAL. The switch also connects humbucker 2's "coil tap" 344 (the negative lead 344 for pickup 4, which is connected to the positive lead 346 for pickup 5) to SIGNAL, thereby cutting pickup 4 326 out of the circuit. Both pickup 5's negative lead 348 and pickup 3's negative lead 340 are hard-wired to ground, so this switch position represents pickup 5 328 and pickup 3 324 wired in parallel. This setting has a noticeably lower output volume than that of setting 1 and is approximately equal to the output volume of setting 2.

In switch position 5, common lead 302 is connected to setting lead 308, and common lead 310 is connected to setting lead 316. Switch position 5 thus connects humbucker 2's positive lead 342 to SIGNAL. Humbucker 2's negative lead 348 is hard-wired to ground, so this switch position represents humbucker 2 (pickups 4 326 and 5 328 wired in series), which has a high output volume. This setting has an output volume equal to that of setting 1.

In this example, the guitar is configured to produce five different sounds, from five different pickup topologies, each having a noticeably different timbre. However, two circuit topologies produce a loud volume (settings 1 and 5), and the other topologies produce a lower volume (settings 2, 3, and 4). Though this circuit is used in commercial guitars, those guitars are not nearly as popular as the Gibson Les Paul or the Fender Stratocaster, in part because, in this design, the guitar's output volume varies from setting to setting. Consequently, on many guitars with the humbucker/single-coil/humbucker pickup arrangement, the single-pole Fender-style 5-way switch is used instead, as indicated by the dotted line 318. The reduced circuit is identical for settings 1, 3, and 5 of the switch. In settings 2 and 4, the entire humbucker is placed in parallel with the single coil (pickup 3 324), thereby creating an output volume that is similar to a humbucker. Though this ensures the volume levels to be similar across four of the pickup-topology settings, there is still a single-coil setting that is significantly lower in output volume, and the other two settings (settings 2 and 4) represent quality trade-offs: the timbres of these settings are more reminiscent of humbuckers than the parallel coils of a Fender Stratocaster.

Figure 11:
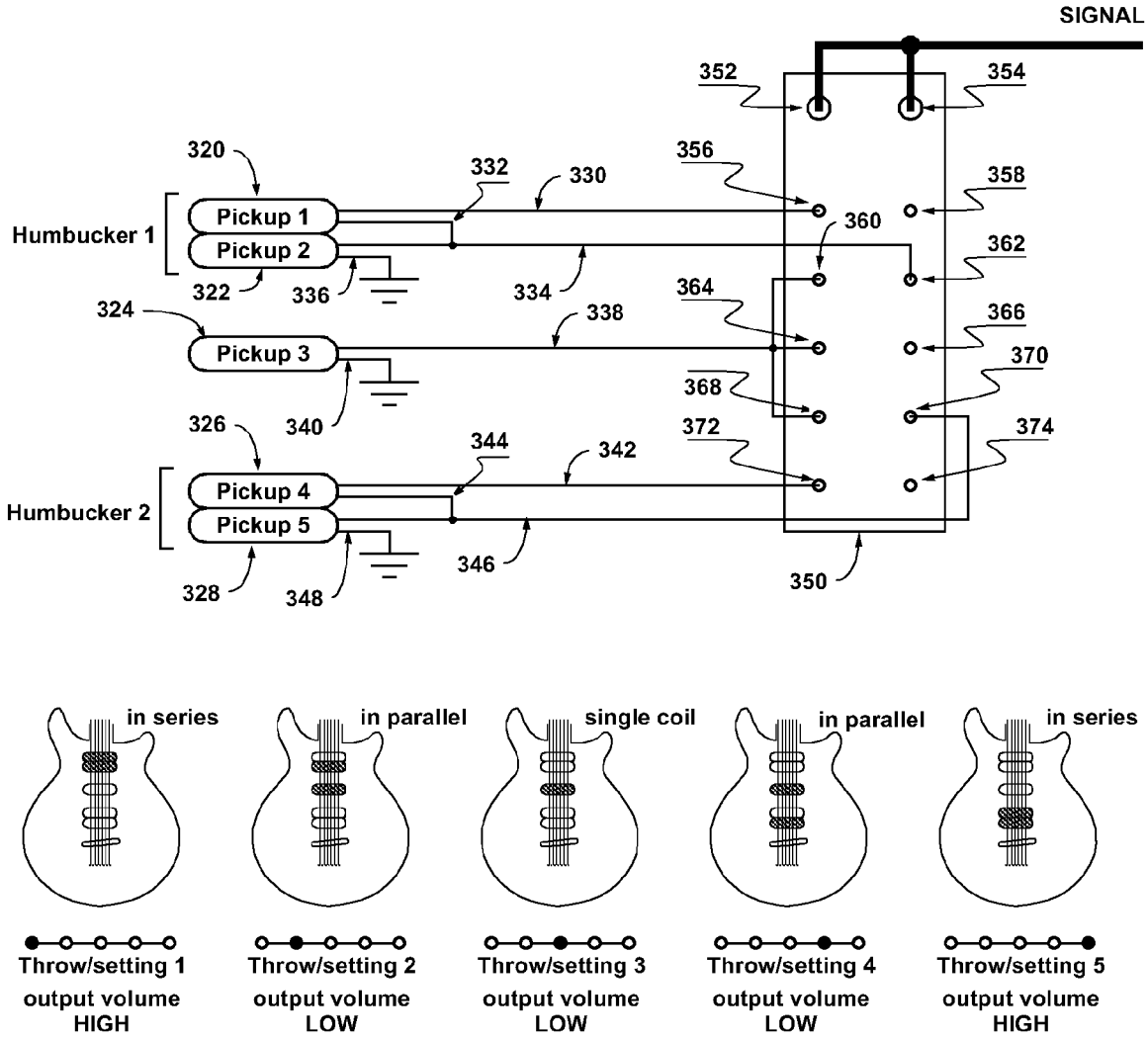
FIG. 11 is an implementation of the configuration in FIG. 10 using a normal 2P5T switch instead of a Fender-style variant.

FIG. 11 shows yet another way to implement the circuit of FIG. 10 and also illustrates that the problem is not simply the use of the on-on-on DPDT or Fender-style 5-way switch variants. This example uses a normal 2P5T switch 350 in place of the Fender 5-way variant, but the resulting circuit still does not support separate volume controls per switch setting. The problem arises due to the way in which the circuit is wired, and this example is no more amenable to individual volume adjustment than the circuit in FIG. 10, because there are not separate circuit paths representing the separate pickup topologies selected by the switch.

FIG. 12 illustrates an embodiment that does solve the problem, by using a larger switch to separate the five distinct signal paths from each other and inserting volume adjustment sub-circuits in the separate paths. Note the five distinct lines 424 426 428 430 432 exiting the switch 400, connecting the switch to the SIGNAL output 424 through volume-adjustment sub-circuits 414 416 418 420 422. This embodiment implements the same pickup topologies as the circuits in FIGS. 10 and 11, but each topology has its own separate volume adjustment, and, if using the volume-adjustment circuit of FIG. 8(*b*), these volume-adjustment circuits are independent.

Note that the orientation of the switch with respect to the pickup leads is not a limitation of the invention. FIG. 13 provides an alternate embodiment to FIG. 12 that does the same thing, and while the embodiment in FIG. 12 has the pickup leads tied to the switch's common leads, the embodiment in FIG. 13 has the pickup leads tied to the switch's setting leads.

In both FIG. 12 and FIG. 13, the embodiment supports the type of volume-adjustment sub-circuit shown in FIG. 8(*b*) but not that shown in FIG. 8(*a*). Were one to implement the volume controls $VOL_1$ $VOL_2$ $VOL_3$ $VOL_4$ and $VOL_5$ using the circuit in FIG. 8(*a*), one would have five resistances in parallel between SIGNAL and GROUND, which is effectively one single resistance between SIGNAL and GROUND; i.e., the five volume adjust circuits would not be independent of each other.

One way to enable the use of the passive volume control shown in FIG. 8(*a*), is to insert another switch into the signal path. FIG. 14 shows such an embodiment. Here, a 1P5T switch 500 is used to buffer the separate signal paths from each other such that only one of the various resistances between SIGNAL and GROUND is connected into the signal path at any given time. A person of ordinary skill in the art would recognize that this additional switch could simply be part of a larger ganged switch 502 that encompasses both the pickup-topology selection switch 450 and the switch 500 used to buffer the signals.

Although particular embodiments of the invention have been described and illustrated herein, it is recognized that modifications and variations may readily occur to those skilled in the art. It is therefore intended that the claims be interpreted to cover such modifications and variations.

The invention claimed is:

1. A volume-adjustment circuit for equilibrating pickup topologies, comprising:
- an output signal line;
- a plurality of pickup leads;
- an m-setting pickup selection switch having
  - a plurality of inputs,
  - at least two outputs; and
  - the m-setting pickup selection switch selects a different pickup topology for at least two settings of the m-setting pickup selection switch;
  - at least two volume adjustment circuits each having an input and an output;
- at least two separate and independent signal paths each path having
  - an input and an output;
  - the plurality of pickup leads connect to the plurality of inputs of the m-setting pickup selection switch;
  - the input of each separate and independent signal path connects to the output signal of the m-setting pickup selection switch, and the outputs of the separate and independent signal path connect to the input of the volume adjust circuit; and
  - the outputs of the volume-adjustment circuits connect to the output signal line of the volume-adjustment circuit for equilibrating pick-up settings, providing separate volume adjustment for each pickup topology of the m-setting pickup selection switch.

2. The volume-adjustment circuit for equilibrating pick-up settings of claim 1 wherein the volume adjustment circuits are active volume adjustment circuits.

3. The volume-adjustment circuit for equilibrating pick-up settings of claim 1 wherein the volume adjustment circuits are passive volume adjustment circuits.

4. The volume-adjustment circuit for equilibrating pick-up settings of claim 1 wherein the circuit is implemented in a hardware description language.

5. The volume-adjustment circuit for equilibrating pickup topologies of claim 1 further comprising
- an output buffer having multiple inputs, an output, and each signal path through the buffer is separate from every other signal path in the buffer;
- the outputs of the volume adjustment circuits connect to the inputs of the output buffer;
- the output of the output buffer is connected to the output signal line; and
- only one signal path of the output buffer is connected to the output signal line at any given time.

6. The volume-adjustment circuit for equilibrating pick-up settings of claim 5 wherein the volume adjustment circuits are passive volume adjustment circuits.

7. The volume-adjustment circuit for equilibrating pick-up settings of claim 6 wherein the output buffer is separate and independent switches.

8. The volume-adjustment circuit for equilibrating pick-up settings of claim 5 wherein the circuit is implemented in a hardware description language.

9. An apparatus for independently adjusting volumes for different pickup topologies in a musical instrument, the apparatus comprising
- an output signal line for the apparatus;
- electronic pickups;
- signal paths from the electronic pickups to the output signal line for the apparatus;
- separate and independent active volume adjustment circuits;
- a pickup topology switch selecting at least two different pickup topologies;
- the electronic pickups connected to the pickup topology switch;
- the pickup topology switch connected to the separate and independent active volume adjustment circuits;
- the separate and independent active volume adjustment circuits come after the musical instrument's pickup topology switch in the signal paths of the apparatus; and
- the separate and independent active volume adjustment circuits independently adjust the volume for different pickup topologies in the musical instrument.

10. The apparatus of claim 9 is implemented in a hardware description language.

11. An apparatus for independently adjusting volumes for different pickup topologies in a musical instrument, the apparatus comprising
- an output signal line for the apparatus;
- electronic pickups;
- a pickup topology switch selecting at least two different pickup topologies;
- separate and independent passive volume adjustment circuits;
- an output buffer having an output connected to the output signal line for the apparatus, separate signal paths through the buffer, and only one signal path of the buffer is connected to the output at any given time;
- the electronic pickups connected to the pickup topology switch;
- the pickup topology switch connected the separate and independent passive volume adjustment circuits;
- the separate and independent passive volume adjustment circuits are connected to the output buffer;
- the separate and independent passive volume adjustment circuits come after the pickup topology switch in the signal paths of the apparatus; and the separate and independent volume adjustment circuits independently adjust volume for different pickup topologies in the musical instrument.

12. The apparatus of claim 11 wherein the output buffer is separate and independent switches.

13. The apparatus of claim 11 wherein the circuit is implemented in a hardware description language.

14. The apparatus of claim 11 wherein the volume adjustment circuits are active.

* * * * *